United States Patent [19]

Harley

[11] 4,126,342

[45] Nov. 21, 1978

[54] SECURITY DEVICE FOR LIMITING THE OPENING MOVEMENT OF A DOOR

[76] Inventor: Andrew W. Harley, 4A Copthall House, Station Sq., Coventry, Warwickshire, England

[21] Appl. No.: 696,695

[22] Filed: Jun. 16, 1976

[30] Foreign Application Priority Data

Jun. 17, 1975 [GB] United Kingdom ..... 25701/75

[51] Int. Cl.[2] ..... E05C 17/16

[52] U.S. Cl. ..... 292/269

[58] Field of Search ..... 70/93; 292/269, 270, 292/273, 274

[56] References Cited

U.S. PATENT DOCUMENTS

| | | | |
|---|---|---|---|
| 1,531,586 | 3/1925 | Wheelock | 292/274 X |
| 1,722,355 | 7/1929 | Ritterson | 292/270 |
| 2,102,729 | 12/1937 | McDonald | 292/269 |
| 3,553,721 | 1/1971 | Hawkins | 70/93 |

FOREIGN PATENT DOCUMENTS

| | | | |
|---|---|---|---|
| 11,631 | 3/1880 | Fed. Rep. of Germany | 292/269 |
| 311,500 | 5/1929 | United Kingdom | 292/273 |

*Primary Examiner*—Richard E. Moore

*Attorney, Agent, or Firm*—Gifford, Chandler, Van Ophem, Sheridan & Sprinkle

[57] ABSTRACT

A security device permitting an inwardly-openable door to be partly opened and to be held by the security device, when operative, from further opening movement. The security device includes a latch mounted on the inside of the door, a retractable bolt, and an arm mounted on a frame member for pivoting about an axis normal to the axis of pivoting of the door. The arm is of hollow box-like construction and has a front wall provided with a slot with which the bolt is engaged. The bolt has a transverse groove in which the edge of the slot is received, the groove is slidable along the edge of the slot and engaged thereby to prevent withdrawal of the bolt from the slot as the door is opened. The slot has at least one end portion from which the groove in the bolt is disengaged when further opening of the door is to be permitted.

7 Claims, 8 Drawing Figures

SECURITY DEVICE FOR LIMITING THE OPENING MOVEMENT OF A DOOR

The invention relates to a security device for limiting the opening movement of a hinged member such as a door to enable the occupant of a house or other building or room to open the door through a sufficient angle to observe and speak to a caller but not through an angle sufficient to enable the caller to pass through the doorway.

The invention is concerned with a modification of the security device described and claimed in our co-pending Patent Application Ser. No. 534,075, filed Dec. 18, 1974.

An object of the invention is to provide a security device of the kind claimed in the aforesaid specification of improved construction from the points of view of manufacture and reliability.

According to the invention, a security device for permitting an inwardly-openable hinged member (hereinafter called a door) to be opened through a limited angle and to be held in a partly-opened position by the security device, when operative, from further opening movement comprises a latch to be mounted on the inside of the door, a retractable bolt included in said latch, and an arm to be mounted on a fixed support adjacent the latch for pivoting about an axis normal to the axis of pivoting of the door, the arm being of hollow box-like construction and having a front wall which, when the door is closed, will be substantially parallel to and adjacent the edge of the door from which the bolt of the latch extends, the front wall having a slot therein in which the bolt is received and defined by an edge in said front wall, said bolt having a transverse groove therein of a width sufficiently great that said edge is received in the groove and the groove is slidable along said edge and is engaged thereby to prevent withdrawal of the bolt from said slot as the door is opened to said partly-opened position and the arm is correspondingly pivoted until an end of said slot has been reached by said bolt and said bolt has been stopped from further movement along said arm, said edge having at least one end portion from which the groove in the bolt is disengaged when further opening of the door is to be permitted.

Conveniently, the transverse groove in the bolt is of crescent-shape and merges at its ends with the peripheral surface of the bolt, means being provided to turn the bolt about its longitudinal axis to effect rolling of the transverse groove from the edge of the slot at the end portion thereof when the bolt is to be disengaged from the arm. The means to turn the bolt about its longitudinal axis may conveniently be effected by a cam-like slot provided in the latch and a pin engaged in the cam-like slot and carried by the bolt, the pin being movable in the cam-like slot when the bolt is moved axially in a direction away from the plane of the slot in the arm. The bolt may be disengaged from the arm, when the door is closed, by a key operable from outside the door and is manually disengaged by means of a knob on the bolt from inside the door.

The end portion of said slot in the front wall of the arm may be an enlarged elongate portion, said bolt being axially inserted and withdrawn, when the door is fully closed, through one end of the enlarged elongate portion and being axially withdrawn when the door is in a position intermediate the fully closed and the partly-opened positions through the other end of the enlarged elongate portion. Alternatively said slot in the front wall of the arm may have at each end thereof an enlarged circular portion through one of which portions said bolt is axially inserted and withdrawn when the door is closed and through the other of which portions said bolt is withdrawn when the door is in the partly-opened position.

A pivot pin may be provided on which the arm is pivotally mounted at one end thereof, said pivot pin having a longitudinal axis which is inclined to the plane of the fixed support, whereby when the arm is pivoted by opening the door to the partly-opened position, the end of the arm remote from the pin has a component of movement in a direction towards the door.

The portion of the arm outwardly of the pivotal mounting thereof may be completely closed by the walls defining the arm except for access to the interior of the arm through the slot in the front wall thereof, thereby to prevent a person outside the door from manipulating the bolt until the transverse groove has become disengaged from the slot in the front wall of the arm.

By way of example, a security device in accordance with the invention is now described with reference to the accompanying drawings, in which.

Figure 1:
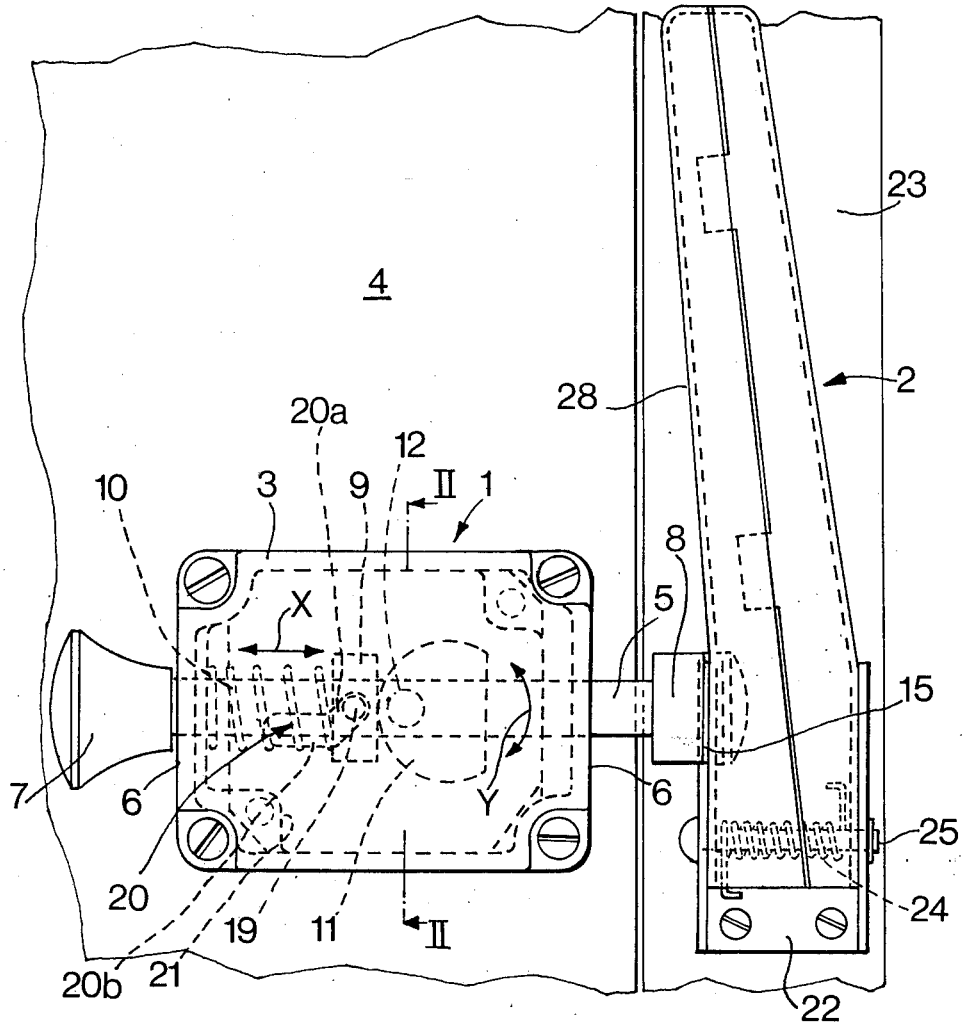
FIG. 1 is an elevation of a latch mounted on the inside face of a hinged door and of a pivotally-mounted arm mounted on the inside face of an adjacent door-frame member, the latch and the arm together comprising the security device.
Figure 2:
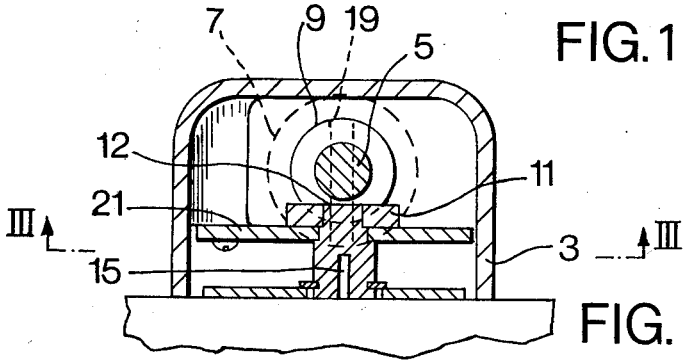
FIG. 2 is a section through the latch on the line II—II in FIG. 1.
Figure 3:
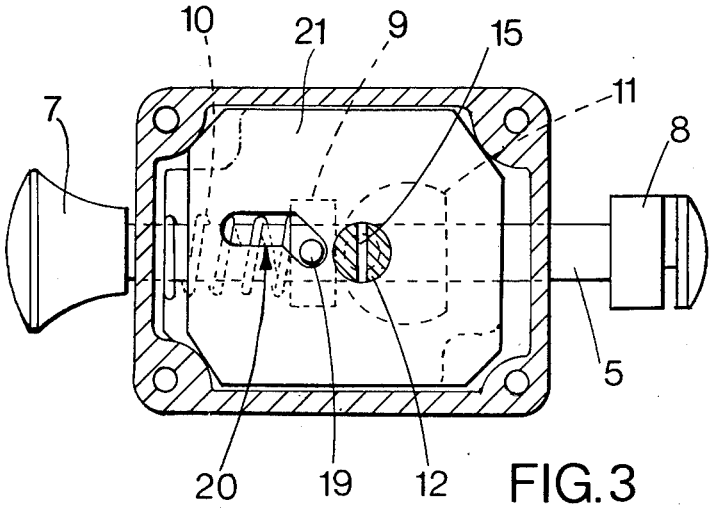
FIG. 3 is a section through the latch on the line III—III in FIG. 2.
Figure 4:
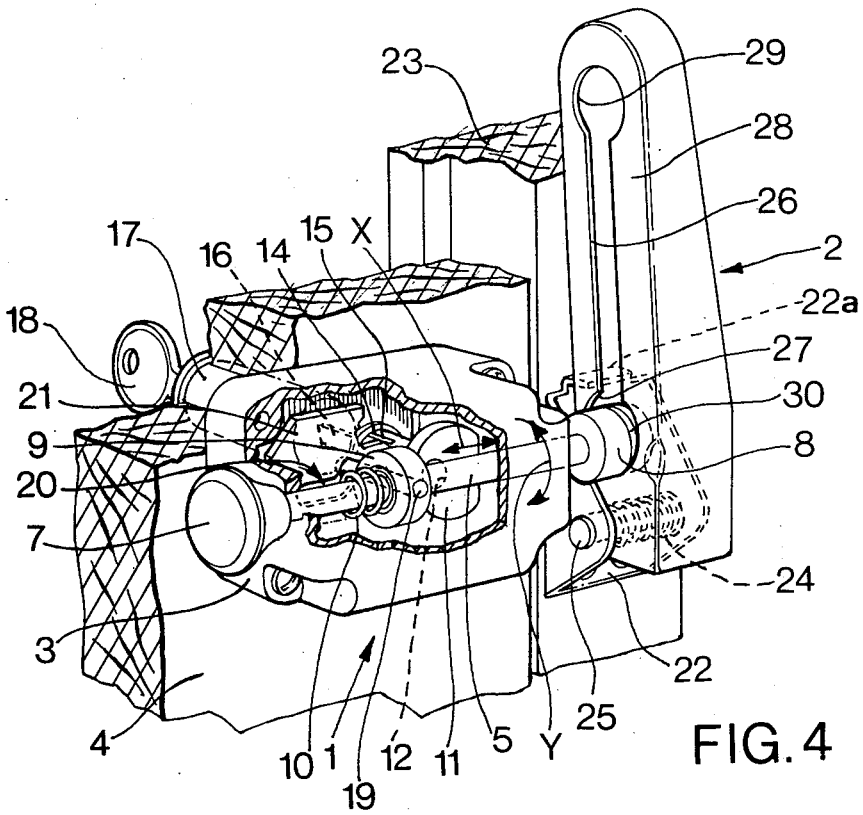
FIG. 4 is a perspective view of the security device and showing the door shut.

The security device of FIGS. 1 to 6 comprises the latch 1 and the pivotally-mounted arm 2. The latch 1 comprises a housing 3 which is screwed to the inside face of the door 4 adjacent the upright edge thereof remote from the hinges (not shown) and a bolt 5 extending through the housing and supported in end walls 6 thereof both for sliding in the directions of arrows X and for turning about its longitudinal axis in the directions of arrow Y (as shown in FIGS. 1 and 4). The end of the bolt 5 further from said remote edge of the door carries a knob 7 and the other end of the bolt 5 is formed to provide a bolt head 8 of cylindrical shape. Between its ends, the bolt 5 carries a collar 9 which is engaged by a helical compression spring 10 acting between the left-hand end wall 6, as viewed in FIG. 1, and the collar 9 to urge the bolt 5 to the right, as viewed in FIG. 1. The end face of the collar 9 remote from the end face thereof engaged by the spring 10 is engaged by a cam 11 mounted for turning about a pin 12 journalled in a plate 21 mounted in the housing 3. The pin 12 has a head 14 extending through to the outside of the housing 3 at the face thereof which will be adjacent the door 4 when the latch 1 is secured thereto. The head 14 has a diametral slot 15 cut therein and engaged by the blade 16 of a cylinder type lock 17 mounted in the front face of the door, as indicated in FIG. 4. A key 18, shown in FIG. 4, is inserted into the lock 17 to turn the cylinder of the lock and hence the cam 11, thereby to withdraw the bolt to the left as viewed in FIG. 1 against the force of the spring 10. The collar 9 carries a pin 19 extending transversely therefrom and engaged in a slot 10 in the plate 21. The slot 20 has a portion 20*a* shaped to impart a combined turning and axial movement to the bolt and a portion 20*b* to impart an axial movement to the bolt when the bolt 5 is moved to the left, as viewed in FIG. 1, by turning the cam 11 or by pulling the knob 7. When the bolt 5 is returned to the right, as viewed in FIG. 1, by the spring 10, the slot 20 will conversely effect an axial movement of the bolt 5 followed by a combined axial and turning movement. The force of the spring 10 acting on the collar 9 also acts to return the cam 11 to the position shown in FIG. 1.

The pivotally-mounted arm 2 is mounted on a bracket 22 which is secured to the inside face of the upright door-frame member 23, as shown in FIG. 1. The bracket 22 carries a pivot pin 25 on which the arm is mounted. The bracket 22 is formed with a flange 22*a* to provide a stop for the arm, as shown in FIG. 4. The bracket 22 is secured to the door-frame member 23, as shown in FIG. 1, in a position in which the pivot pin 25 is horizontal. The arm 2 is biased by a torsion spring 24 to a position in which it extends upwardly against the stop 22*a*, as shown in FIG. 4, and in which position the face of the arm adjacent the door-frame member 23 is substantially parallel with the door-frame member. The arm 2 can be pivoted away from the stop 22*a* against the bias of the spring 24, to the position shown in FIG. 5 in which the arm 2 extends from the door-frame member 23 at an angle of substantially 75° thereto. The arm 2 is inclined towards the adjacent edge of the door so that when the arm pivots about the pivot pin 25, the free end of the arm 2 will have a component of motion towards the door in addition to its forward pivotal movement. The arm 2 is in the form of a rigid closed box having a front face 28 in which there is a longitudinal slot 26 along which the bolt head 8 can travel, as the arm 2 pivots about the pivot pin 25 from the position shown in FIG. 4 to the position shown in FIG. 5, as hereinafter described. Each end 27 and 29 of the slot 26 is of a larger circular shape, whereby the whole slot is of the shape of a double-ended keyhole. The circular portion at each end of the slot has a diameter sufficiently large as to enable the bolt head 8 to be inserted or withdrawn therethrough. The bolt head cannot pass through the narrower straight part of the slot. The bolt head 8 has a transverse groove 30 in one side thereof having a width greater than the thickness of the front face 28 of the arm 2 adjacent the edges of the slot 26. When the bolt head 8 has entered the lower end portion 27, that is the end portion of the slot nearer to the pivot pin 25, and the bolt 5 has been urged fully to the right as viewed in FIG. 1, the bolt head 8 will travel along the slot 26, when the door is opened as hereinafter described, and one edge of the slot will engage in the groove 30, thereby preventing the withdrawal of the bolt 5 and hence the bolt head 8 from the slot 26. When the bolt head 8 reaches the end portion 29 of the slot an edge bounding the end portion 29 will still be located in the groove 30 and so the bolt head 8 is still retained by the arm 2. The groove 30 is of crescent-shape and merges at its ends with the cylindrical surface of the bolt head 8. After the bolt head 8 has reached the end portion 29 of the slot and the bolt 5 is urged to the left, as viewed in FIG. 1, either by turning the cam 11 by the key 18 or by pulling the knob 7 to the left, the portion 20*a* of the slot 20 will effect an initial combined turning and axial movement of the bolt 5 and thus of the bolt head 8. Due to the crescent-shape of the groove 30, the latter will be disengaged from the retaining edge of the end portion 29 of the slot, thereby permitting the bolt head 8 on continued axial movement of the bolt 5 determined by the slot portion 20*b* to be withdrawn through the end portion 29 of the slot in the front face 28 of the arm, thereby releasing the door for continued opening movement. As the arm 2 pivots through substantially 75° from its rest position, in which it is parallel with the door-frame member 23, to its fully extended position, the door-frame member 23, to its fully extended position, the bolt 5 and the bolt head 8 have to be turned through substantially 15° in order to disengage the bolt head 8 from the retaining edge of the end portion 29 of the slot. The turning of the bolt 5 and the bolt head 8 through substantially 15° is produced by the length and the inclination of the slot portion 20*a*.

Figure 5:
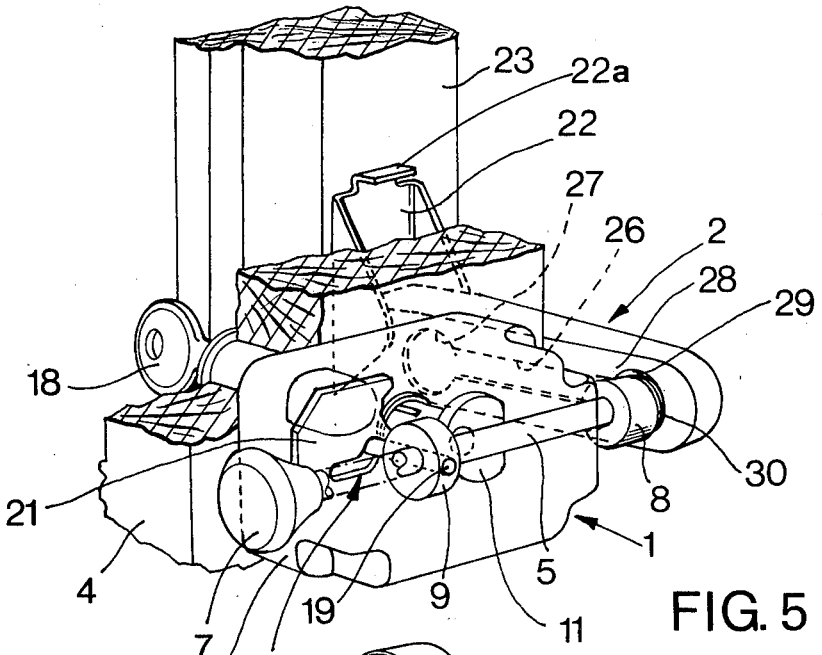
FIG. 5 is a perspective view of the security device and showing the door opened through the maximum angle permitted by the security device while the latch is engaged with the arm.
Figure 6:
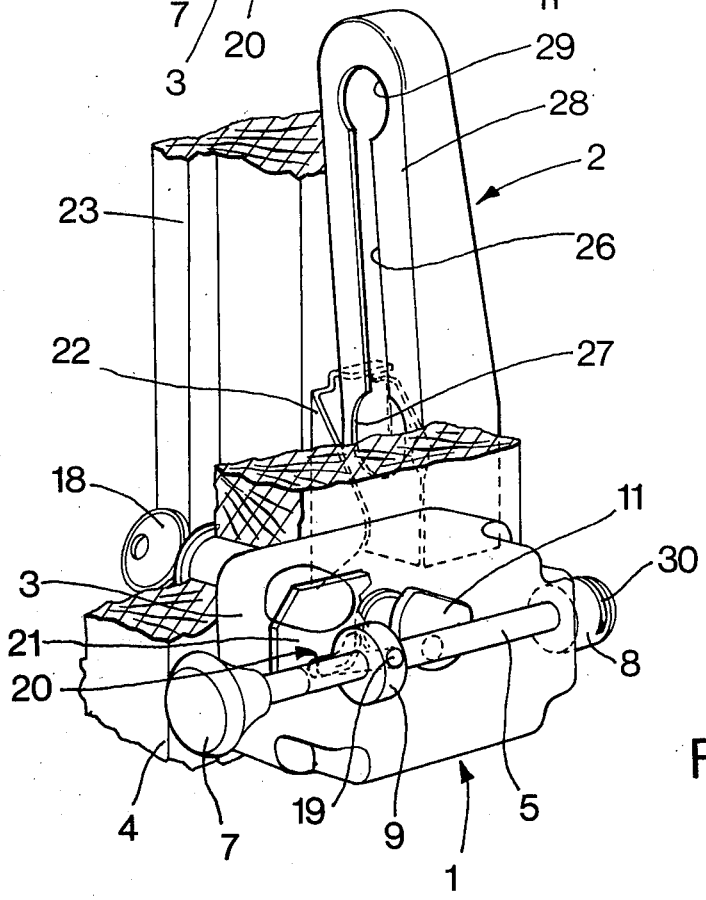
FIG. 6 is a perspective view of the security device and showing the door partly open and the latch disengaged from the arm.

The operation of the security device is now described with reference to FIGS. 4 to 6. When the door 4 is shut, as shown in FIG. 4, the latch member 8 will enter the circular portion 27 of the slot 26 in the front face 28 of the arm 2 under the force of the spring 10 until the groove 30 reaches the plane of the front face 28 so that the bolt head 8 can only be withdrawn to the left by the key 18 or the knob 7. The door has a conventional lock (not shown) openable in usual manner by a key from the outside of the door or by a knob from the inside. On unlocking the door in this way, it can then be partly opened from its shut position. During this limited movement, the bolt head 8 will slide along the slot 26 and one edge of the slot 26 will engage in the groove 30 and thus the bolt head 8 will be retained in the slot 26 by the one edge of the slot 26 in the front face 28 remaining in the groove 30 as the bolt head slides along the slot 26. As this occurs so the arm 2 will be pivoted away from the stop 22*a* and the frame member 23 through an angle of approximately 75° until the bolt head 8 reaches the end portion 29 of the slot as shown in FIG. 5. In this position an edge bounding the end portion 29 of the slot will still be engaged in the groove 30 and so the bolt head 8 will be securely held and further opening of the door is prevented unless the key 18 is used from outside the door or the knob 7 is pulled to the left (as in FIG. 1) from inside the door. Either of these movements will effect turning of the bolt 5 and the bolt head 8 through an angle of approximately 15° by the slot portion 20*a*, thereby disengaging the groove 30 from the edge of the end portion 29 of the slot and permitting the bolt head 8 on continued movement of the bolt 5 to the left (as in FIG. 1) to be withdrawn through the end portion 29 of the slot. As soon as this occurs, the door can be opened freely and the arm 2 will be returned by the spring 24 to its rest position as illustrated in FIG. 6. When the door is shut again the bolt head 8 will re-enter the end portion 27 of the slot 26.

When an authorised person having a key 18 wishes to open the door from the outside he will after releasing the conventional lock by using an appropriate key (not the key 18), use the key 18 to disengage the bolt head 8 from the end portion 29 of the slot if the door has been partly opened, as shown in FIG. 5, or from the end portion 27 of the slot if the door is in the shut position as shown in FIG. 4. Alternatively, if the door has been opened from the inside, the door cannot be opened beyond the limited angle, as shown in FIG. 5, until the person inside the building or room uses the knob 7 to disengage the bolt head 8 from the arm 2. As the arm 2 is in the form of a closed box, it is not possible for an entry to be made by a person outside the door by him trying to release the bolt head by manually pushing it from the slot. There is therefore security while the occupant of the building or room closed by the door can look through the gap between the partly-opened door and the door-frame when the door and the security device are in the FIG. 5 position. Only when the occupant is satisfied that the door should be opened will he withdraw the bolt 5 by means of the knob 7 thereby to move the pin 19 along the slot 20 to disengage the bolt head 8 from the arm 2. The bolt head 8 and the arm 2 are made of hardened steel and cannot be forced apart.

Although in the foregoing example, the arm is pivoted through substantially 75°, any other convenient angle of pivoting may be provided when designing the arm, provided the angle selected is compatible with the angle of turning of the bolt 5 as determined by the length and inclination of the slot portion 20*a*, thereby to ensure that the bolt head will be retained in the slot 26 until the bolt head has been turned to disengage the groove 30 from the edge of the end portion 29 of the slot.

Figure 7:
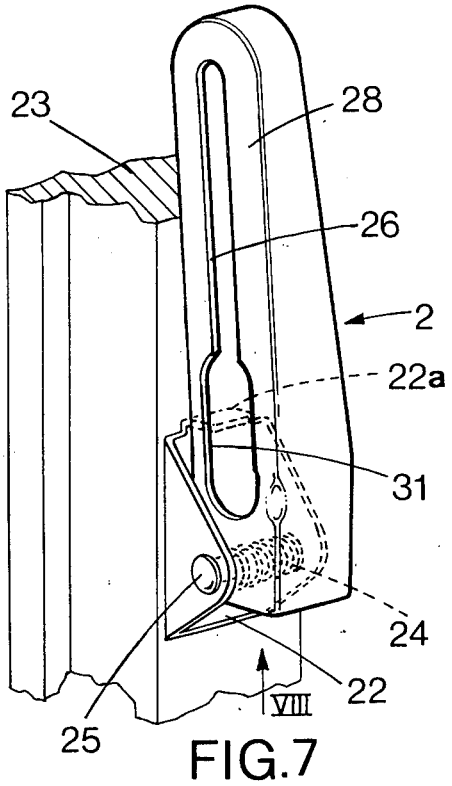
FIG. 7 is a perspective view of a modified form of the pivotally-mounted arm shown in FIGS. 1 and 4 to 6 in the position it occupies when the door is open beyond said limited position.
Figure 8:
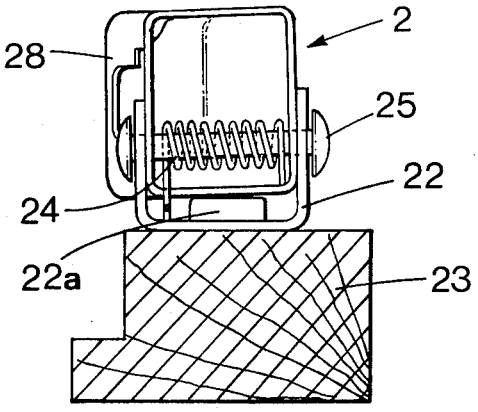
FIG. 8 is an end view in the direction of arrow VIII in FIG. 7.

Reference is now made to FIGS. 7 and 8 showing a modified pivotally-mounted arm and in which parts corresponding to those shown in FIGS. 1 and 4 have been given the same reference numerals. The modified pivotally-mounted arm 2 is mounted on the bracket 22 which is secured to the door-frame member 23 in a similar manner to that described with reference to FIG. 1. The arm 2 is mounted on the pivot pin 25 which is carried by the bracket 22 and the arm is biased into the position shown against the stop 22*a* by the torsion spring 24. The arm is in the form of a rigid closed box having the front face 28 in which there is the longitudinal slot 26 along which the bolt head can travel as hereinbefore described. As shown in FIG. 7, instead of providing each end of the slot with the portions 27 and 29 of larger circular shape as shown in FIGS. 4 to 6, the end of the slot 26 nearer to the pivot pin 25 has an enlarged elongate portion 31. The width of the enlarged portion 31 is substantially the same as the diameter of end portion 27 of the slot in the arm shown in FIG. 4 and is sufficiently large to enable the bolt head 8 to be inserted or withdrawn therethrough. The bolt head cannot pass through the narrower part of the slot 25 which is of substantially the same width as the portion of the slot 26 between the end portions 27 and 29 in FIG. 4. As shown in FIG. 8, the pivot pin 25 although still mounted horizontally with respect to the door-frame member, is inclined to the plane of the door-frame member 23 instead of being parallel therewith and the side limbs of the bracket 22 are also inclined so that the longitudinal axis of the pivot pin 25 is substantially normal to the side limbs of the bracket. In addition the arm 2 is also inclined as shown in FIG. 8. By inclining the pivot pin 25 and the arm 2, the component of movement of the free end of the arm towards the door as the arm 2 is pivoted to a position corresponding to the position of the arm shown in FIG. 5 on opening the door will be greater in this embodiment. Therefore by employing the arm shown in FIGS. 7 and 8 with the latch 1, the security device can be used for a door of narrower width, that is a door having a small radius of opening, than can the security device shown in FIGS. 1 and 4 to 6. The bolt head 8 is inserted and withdrawn from the enlarged portion 31 in a similar manner as hereinbefore described. However when the door has been partly opened and the bolt head is at the end of the slot 26 in a position corresponding to that shown in FIG. 5 and the door is to be fully opened, the door has to be first partly closed, but not necessarily shut, to position the bolt head in the enlarged portion 31 at the end thereof remote from the pivot pin 25. Then the bolt head can be withdrawn as already described herein. The length of the enlarged portion 31 is chosen so that when the bolt head 8 is at the end of the portion 31 remote from the pivot pin 25, any gap between the outside edge of the door and the adjacent corner on the inside of the door-frame member 23 will be so small that it would not be possible for an unauthorised person outside the door to manipulate the bolt manually in an attempt to withdraw the bolt head from the slot in the arm.

As in our said co-pending Patent Application, the security device is effective automatically and does not require the previous engagement of a security device, such as a door chain. Another advantage is that the security device provided by the invention does not require the door to be fully closed before it can be disengaged as does a door-chain. The security device is therefore very useful where old, infirm or absent-minded people or children may have to answer the door to strangers. Another advantage is that as the pivoted arm pivots about a horizontal axis, it can be readily fixed on a narrow door-frame member.

To avoid the need to provide two locks, requiring the use of two keys, to open a door fitted with the security device of this Application, the lock used to withdraw the bolt 5 by means of the cam 11 may be a cylinder lock of the "night lock" type that is a lock having a cylinder providing a second locking position to be brought into effect after a second turning movement of the key. The bolt 5 would be arranged to be moved by a second turn of the key to a position in which the bolt head extends into the arm 2 beyond the position shown in FIG. 4 and engages a keeper integral with the bracket 22. Thus a person requiring to open the door from the outside would turn his key once, to withdraw the bolt 5 and the bolt head partly to the position shown in FIG. 4, and then again to disengage the bolt head 8 from the arm, after the latter has been swung from the position shown in FIG. 4 to that shown in FIG. 5.

What I claim as my invention and desire to secure by Letters Patent of the United States is:

1. A security device for permitting an inwardly-openable hinged door to be opened through a limited angle and to be held in a partly-opened position by the security device, when operative, from further opening movement, the security device comprising a latch to be mounted on the inside of the door, a retractable bolt included in said latch, and an arm to be mounted on a fixed support adjacent the latch for pivoting about an axis normal to the axis of pivoting of the door, the arm being of hollow box-like construction and having a front wall which, when the door is closed, will be substantially parallel to and adjacent the edge of the door from which the bolt of the latch extends, the front wall having a slot therein in which the bolt is received and defined by an edge in said front wall, said bolt having a transverse groove therein of crescent-shape and merging at its ends with the peripheral surface of the bolt, the width of the groove being sufficiently great that said edge is received in the groove and the groove is slidable along said edge and is engaged thereby to prevent withdrawal of the bolt from said slot as the door is opened to said partly-opened position and the arm is correspondingly pivoted until an end of said slot has been reached by said bolt and said bolt has been stopped from further movement along said arm, said edge having at least one end portion from which the groove in the bolt is disengaged when further opening of the door is to be permitted, means being provided to turn the bolt about is longitudinal axis to effect rolling of the groove from the edge of the slot at the end portion thereof when the bolt is to be disengaged from the arm.

2. A security device as claimed in claim 1 in which the means to turn the bolt about its longitudinal axis is effected by a cam-like slot provided in the latch and a pin engaged in the cam-like slot and carried by the bolt, the pin being movable in the cam-like slot when the bolt is moved axially in a direction away from the plane of the slot in the arm.

3. A security device as claimed in claim 1 in which the end portion of said slot in the front wall of the arm is an enlarged elongate portion, said bolt being axially inserted and withdrawn, when the door is fully closed, through one end of the enlarged elongate portion and being axially withdrawn when the door is in a position intermediate the fully closed and the partly-opened positions through the other end of the enlarged elongate portion.

4. A security device as claimed in claim 1 in which said slot in the front wall of the arm has at each end thereof an enlarged circular portion through one of which portions said bolt is axially inserted and withdrawn when the door is closed and through the other of which portions said bolt is withdrawn when the door is in the partly-opened position.

5. A security device as claimed in claim 1 including a pivot pin on which the arm is pivotally-mounted at one end thereof, said pivot pin having a longitudinal axis which is inclined to the plane of the fixed support, whereby when the arm is pivoted by opening the door to the partly-opened position, the end of the arm remote from the pin has a component of movement in a direction towards the door.

6. A security device as claimed in claim 1 in which the portion of the arm outwardly of the pivotal mounting thereof is completely closed by the walls defining the arm except for access to the interior of the arm through the slot in the front wall thereof.

7. A security device as claimed in claim 1 in which the bolt is disengaged from the arm, when the door is closed, by a key operable from outside the door and is manually disengaged by means of a knob on the bolt from inside the door.

* * * * *

UNITED STATES PATENT OFFICE

CERTIFICATE OF CORRECTION

Patent No. 4,126,342 Dated November 21, 1978

Inventor(s) Andrew William Harley

It is certified that error appears in the above-identified patent and that said Letters Patent are hereby corrected as shown below:

Column 5, line 55, delete "25" and insert -- 26 --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*